US011320221B2

(12) United States Patent
Kastrun

(10) Patent No.: US 11,320,221 B2
(45) Date of Patent: May 3, 2022

(54) FIREARM WITH A MAGAZINE HOLDER

(71) Applicant: GLOCK TECHNOLOGY GMBH, Ferlach (AT)

(72) Inventor: Mario Kastrun, Maria Rain (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 17/061,898

(22) Filed: Oct. 2, 2020

(65) Prior Publication Data

US 2021/0102767 A1 Apr. 8, 2021

(30) Foreign Application Priority Data

Oct. 4, 2019 (EP) ..... 19201444

(51) Int. Cl.
*F41A 3/72* (2006.01)
*F41A 9/24* (2006.01)
*F41A 35/06* (2006.01)

(52) U.S. Cl.
CPC ..... *F41A 3/72* (2013.01); *F41A 9/24* (2013.01); *F41A 35/06* (2013.01)

(58) Field of Classification Search
CPC ..... F41A 35/06
See application file for complete search history.

(56) References Cited

U.S. PATENT DOCUMENTS 4,615,134 A 10/1986 Beretta
5,519,954 A * 5/1996 Garrett ..... F41A 17/38 42/6
8,713,832 B2 5/2014 Troy
9,599,419 B2 3/2017 McGinty
2006/0123683 A1* 6/2006 Garrett ..... F41A 35/06 42/6
2010/0281736 A1* 11/2010 Mayberry ..... F41A 21/481 42/49.01

FOREIGN PATENT DOCUMENTS

EP 2823249 B1 4/2014

* cited by examiner

*Primary Examiner* — Bret Hayes
(74) *Attorney, Agent, or Firm* — Raven Patents, LLC; Anton E. Skaugset

(57) ABSTRACT

Firearms including magazine holders operable from either side of the firearm. The magazine holder includes two interconnected actuating elements, pivotable with respect to one another and separable from one another by longitudinal shifting, and a spring. The magazine holder is configured so that when pressure is applied to a right actuating element, a moment of force is applied to a first actuating element, which it cannot follow, and so both actuating elements, without changing their relative position to one another, are shifted against the force of the spring normal to the weapon median plane, removing a locking extension from the magazine housing. Upon actuation of the left actuating element, a stop on the right actuating element prevents its shift transverse to the weapon median plane, and so the first actuating element pivots against the force of the spring, and the locking extension is again moved from the locking element.

18 Claims, 7 Drawing Sheets

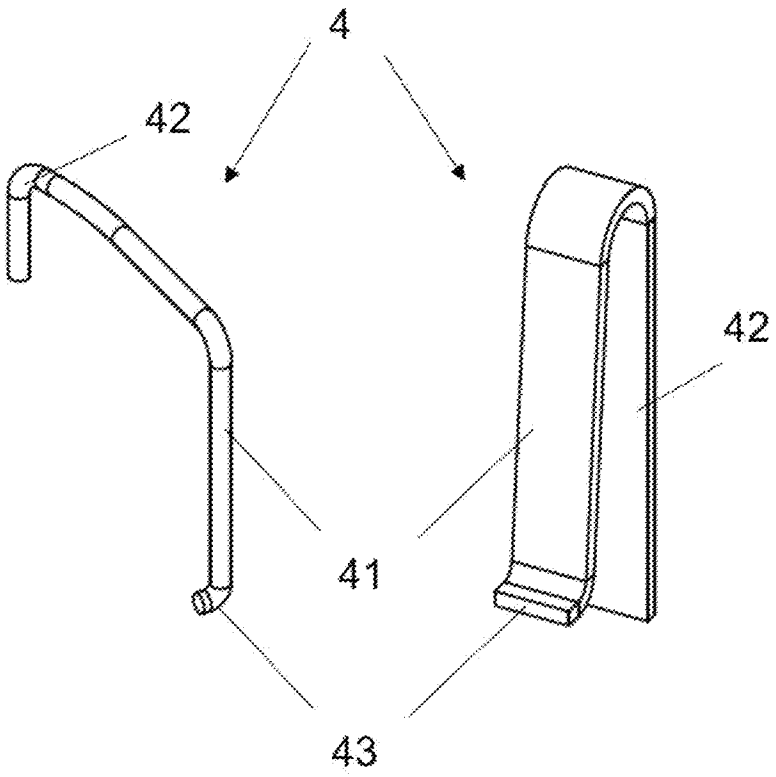
Fig.9B
Fig.9A
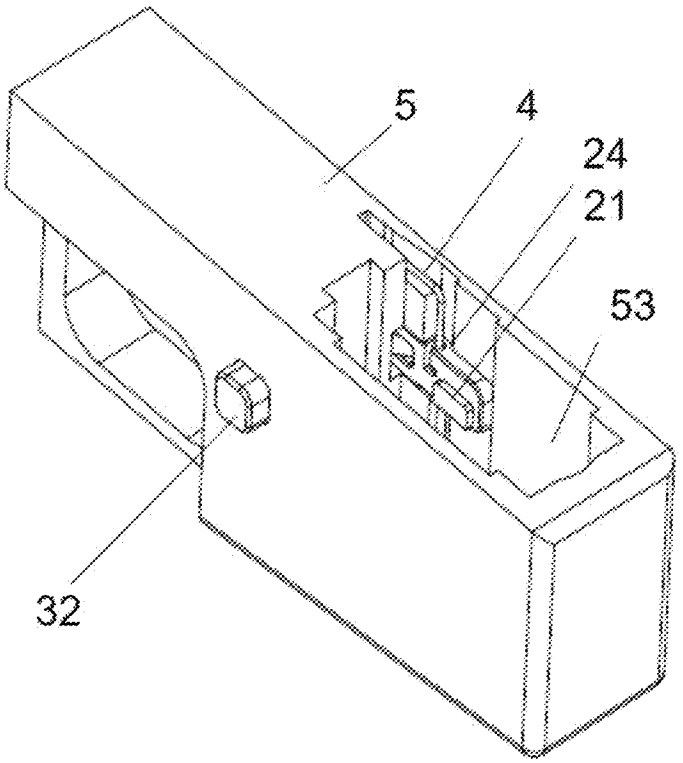
Fig.8

FIREARM WITH A MAGAZINE HOLDER

FIELD OF THE INVENTION

The present disclosure is directed to firearms, and more particularly, to firearms having a magazine holder for magazines that include a lateral locking element on the magazine housing.

BACKGROUND

When operating pistols and rifles, the temporary, easily detachable mounting of an ammunition magazine in a corresponding well is a topic of no small importance. Magazines are secured against slipping out of the magazine well—and therefore out of the weapon—by a magazine holder which engages in the locking element of the magazine. Such a locking element can be, e.g., a catch, an extension, or preferably a recess (indentation or opening) on the outer shell or housing of the magazine, with which a complementary catch, extension, latch, or the like of the magazine holder engages and/or meshes.

A multiplicity of magazines have such locking elements on a side of the magazine housing (where "side" is relative to a magazine in its inserted state and with respect to the weapon's longitudinal axis or the weapon's median plane). Most widely used are magazines that are compatible with rifles of the AR-15, M-16, M-4, or similar type. In these cases, a recess is most commonly formed on the magazine housing, in which a movable latch of the magazine holder can engage.

Over the years, and in response to an increasing demand, a large number of magazine holders have been developed for such magazines that can be actuated on one or both sides. A skilled artisan is well aware of magazine holders that use one or more levers and springs to allow for operation on either sides. Representative examples have been described in U.S. Pat. Nos. 8,713,832B2, 5,519,954A, 4,645,134A, 9,599,419B2, and EP2823249B1 (hereby incorporated by reference).

In U.S. Pat. No. 8,713,832B2, the disclosed magazine is released via a multi-piece, spring-loaded magazine holder, wherein an actuation, as seen in the barrel direction from the right, results in a deflection of the entire magazine holder to the left. In this case, the magazine catch (a term also frequently used in German), which is arranged on a holding arm in the inward direction toward the magazine, is deflected so far to the left that a release of the magazine takes place. A release button, which is attached to the holding arm and supported by the enclosure of the magazine well, also allows for a deflection of the magazine catch to the left when actuated.

Similarly, a gearing of the actuation from the left is disclosed in U.S. Pat. No. 5,519,954A, where the holding arm with the magazine catch, spring-mounted and rotatable about a weapon-mounted bearing journal, is located in a magazine holder housing which, upon actuation, assumes the support on the housing (lower).

U.S. Pat. No. 4,645,134A also discloses a multi-piece magazine holder with an internal spring. Upon actuation from the left, the magazine can be released in that the release is supported by the housing via a lever, resulting in a lateral deflection of the holding arm due to the rotary connection to the internally arranged holding arm.

Analogously, EP2823249B1 shall be mentioned, which, in a reverse arrangement, has a holding arm with a longitudinal slot, in which a handle is arranged for an actuation from the left. The support on the magazine housing is provided via a bulge on the handle; as a result, the holding arm can be deflected laterally until the magazine is released.

An alternative approach is provided by U.S. Pat. No. 9,599,419B2, where the magazine holder has a gearing by means of an actuating element acting on both sides. This magazine holder also comprises screws and springs but an actuation from right to left effects a sophisticated deflection of the actuating element in the vertical direction normal to the barrel axis, resulting in both cases in a coupled deflection of the holding arm or the magazine catch.

Such magazine holders that are operable on both sides are also widely used for pistols and have a multiplicity of components and more or less complicated gearing devices for a force transmission in case of a release movement from the "left." In addition, numerous other magazine holders are known from the prior art that require one or even more springs to return the magazine holder to its original position and/or to pretension the magazine catch. However, the individual elements of such systems require frequent maintenance, and the magazine holder becomes error-prone and/or susceptible to contamination with increasing complexity. In addition, the problem of the security against loss for the individual elements is not consistently ensured for the magazine holders described. All known magazine holders additionally require one, occasionally even several tools for installation and/or maintenance. This is particularly problematic under harsh operating conditions such as may occur in the field.

What is needed, therefore, is a magazine holder that can be actuated on both sides of the weapon median plane, and which overcomes the aforementioned disadvantages of the prior art, and has the lowest possible number of individual components. In addition, the present disclosure addresses the problem of providing, at least in one embodiment, a magazine holder which can be assembled without tools and still arranged securely against loss in the magazine well. A further problem addressed by a development of the present disclosure is that the magazine holder requires a preferably even release force from both sides.

SUMMARY

The present disclosure is directed to firearms that utilize ammunition magazines, where the firearm includes a magazine holder that can be actuated at both sides of the firearm In some embodiments, the disclosure relates to firearms including a firearm housing defining a magazine well; and a magazine holder comprising a first actuating element, a second actuating element, and a spring; the first actuating element having a first actuating extension at a first end of the first actuating element where the first actuating extension protrudes outward relative to a median plane of the firearm; and a locking extension at a second end of the first actuating element that protrudes inward relative to the firearm median plane; such that the locking extension is configured to engage a recess defined in a housing of a magazine when the magazine is inserted in the magazine well so as to reversibly secure the magazine within the magazine well; the first actuating element defining a longitudinal guide extending from the first end of the first actuating element; the second actuating element having a second actuating extension at a first end of the second actuating element; and a second end of the second actuating element is configured so that when the second actuating element is disposed in an insertion position the second end can be inserted into the longitudinal guide of the first actuating element, wherein the second actuating element is rotatable around a rotational axis at the second end of the second actuating element, and can be pivoted around the rotational axis from the insertion position to an installation position; wherein when the second actuating element is in the installation position, the first actuating element and the second actuating element are thus operatively and movably coupled, and the first actuating element is pretensioned by the spring against the firearm housing so as to urge the first actuating element toward the firearm median plane, the first actuating extension and the second actuating extension are therefore symmetrically disposed on the firearm housing with respect to the firearm median plane; and an inward release movement of the first actuating extension will pivot the first actuating element around the rotational axis and thereby disengage the locking extension from the recess in the magazine housing; and an inward release movement of the second actuating extension will translate the first actuating element away from the firearm median plane and thereby disengage the locking extension from the recess in the magazine housing; such that an inward urging of either the first or second actuating extension releases the magazine reversibly secured within the magazine well.

The problems displayed by previous magazine holders are eliminated in that the disclosed magazine holder comprises only two interconnected actuating elements which, within boundaries, are pivotable to one another about an axis and separable from one another in an angular position by longitudinal shifting, and a spring. In the installation state or position (=installation situation), the two actuating elements are in the limit position of the pivoting, in which no shifting is possible.

When pressure is applied to the second, the right, actuating element, a moment of force is applied to the first actuating element, which it cannot follow in the limit position and due to the installation situation in the weapon, and so both actuating elements, without changing their relative position to one another, are shifted against the force of the spring normally to the weapon median plane, whereby the locking extension provided on the first, the left, actuating element is moved from the locking element of the magazine.

Upon actuation of the first, the left, actuating element, a stop on the second, right, actuating element prevents its shift transversely to the weapon median plane; as a result, the torque thus generated pivots the first actuating element against the force of the spring about the axis, and so the locking extension is moved from the locking element.

BRIEF DESCRIPTION OF THE DRAWINGS

FIG. 8 shows a perspective view of the installation situation.

FIGS. 9A and 9B depict two different springs suitable for use in the present disclosure.

DETAILED DESCRIPTION

The present disclosure is directed to weapons that are typically firearms utilizing ammunition magazines, and may therefore be applicable to both long guns and pistols. Most typically, the present disclosure is applicable to rifles. In the context of this disclosure a magazine holder is regarded as a synonym for a magazine release.

In the illustrations of the drawings, "2n" denotes everything relating to the first, left, actuating element, "3n" denotes everything relating to the second, right, actuating element, "4n" denotes everything relating to the spring, and "5n" denotes everything relating to the "remaining" weapon. The magazine holder as a whole is denoted with 1.

Figure 1:
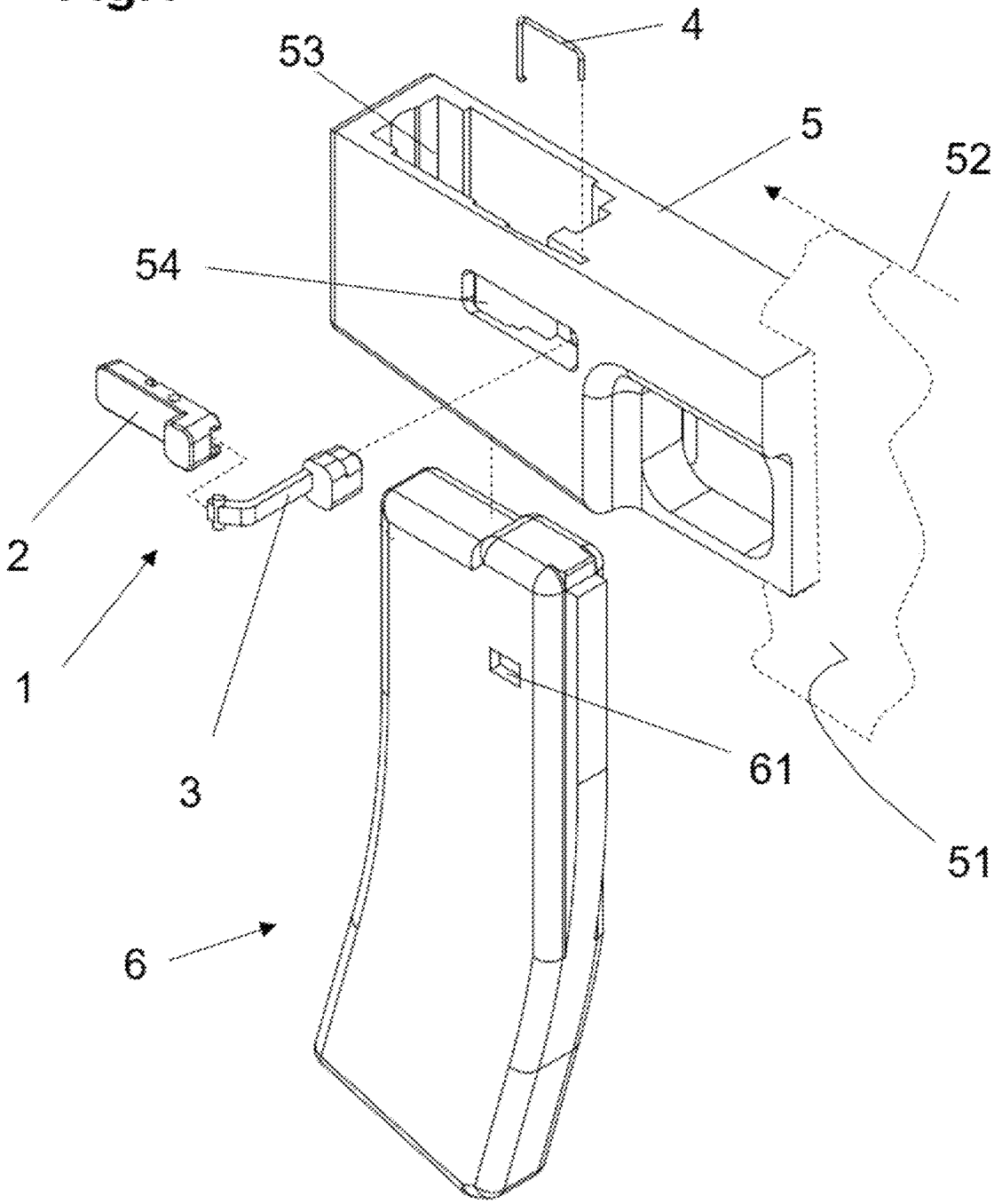
FIG. 1 shows the installation situation purely schematically and in an exploded view.

FIG. 1 shows a perspective, schematic view of a weapon housing 5 in the area of the magazine 6, where weapon housing 5 defines a magazine well 53 configured to receive magazine 6. For a better understanding, the weapon median plane 51 and the barrel direction 52, i.e., the direction of the bore axis, are also indicated. A magazine holder 1 according to the present disclosure, consisting of a first, left, actuating element 2, a second, right, actuating element 3, and a spring 4 is shown in the manner of an exploded view. On magazine 6, a locking element 61 in the form of a recess in a magazine housing 62 can be seen.

Figure 2:
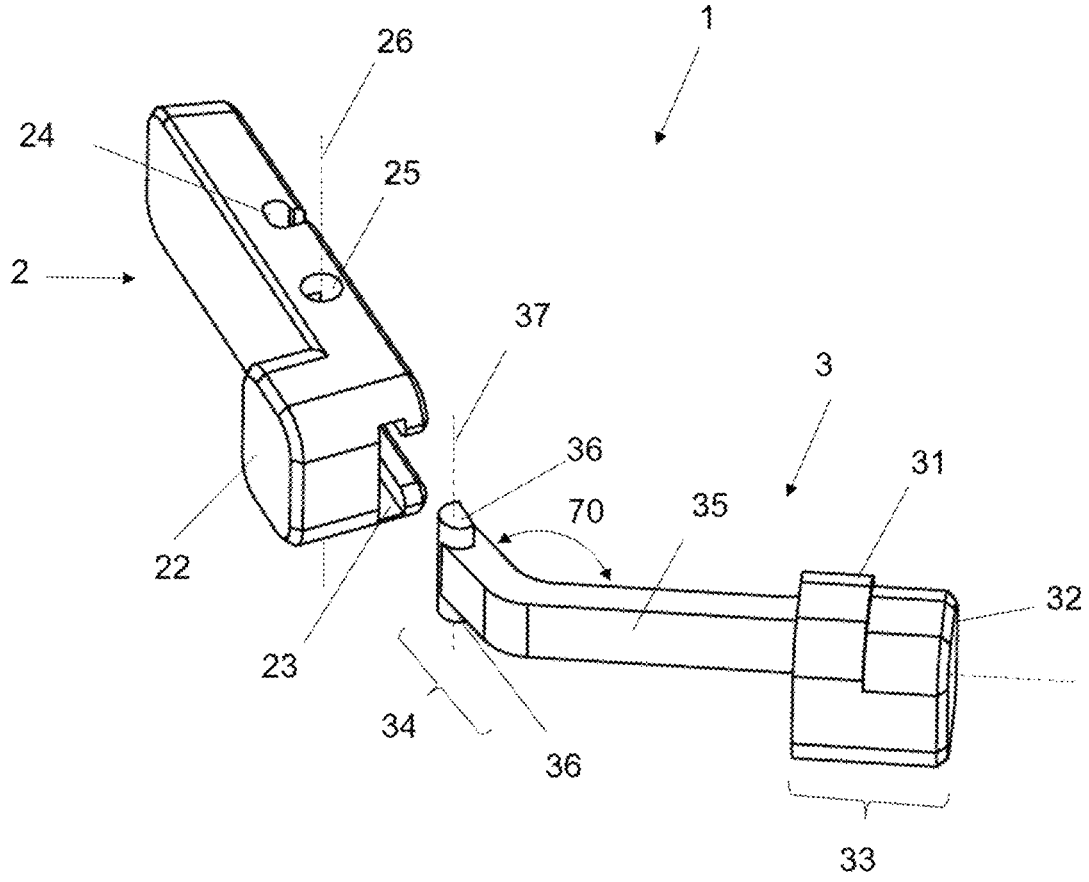
FIG. 2 shows a perspective view of the two actuating elements before assembly.

FIG. 2 shows a perspective view of the two actuating elements 2, 3, in the relative position appropriate for assembly. The first, left, actuating element 2 has a generally elongated-solid shape with a first actuating extension 22, an undercut longitudinal guide 23 of a spring seat 24, and a bearing recess 25 which defines a bearing axis 26. The bearing recess 25 preferably consists of a through-bore.

The second, right, actuating element 3 has a generally slim-curved shape with a second actuating extension 32 with a support thickening 31, which are formed on a first end section 33. By means of a connecting section 35, a second end section 34, angled about an opening angle 70, is provided. In principle, circular cylindrical guide extensions 36 are formed normally to the plane of the actuating element 3 defined by the angulation, but said guide extensions have flattened portions approximately parallel (FIG. 5B) to the alignment of the second end section 34. It has proved to be particularly advantageous if the opening angle 70 lies between 120° and 140°, preferably between 125° and 135°, and particularly preferably between 127.5° and 132.5°.

Figure 4A:
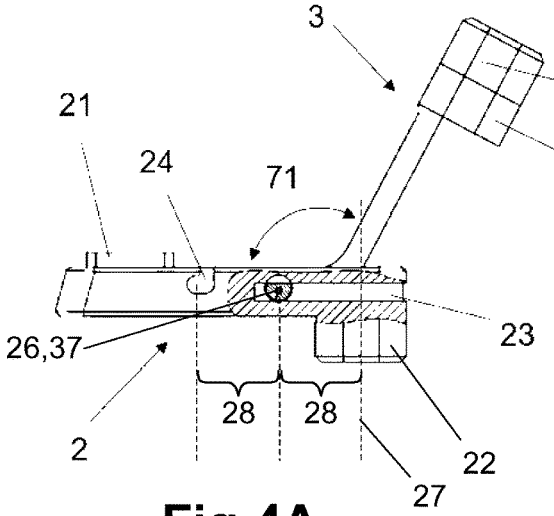
FIGS. 4A and 4B, show a partially sectional view of the two assembled actuating elements in two different angular positions.
Figure 4B:
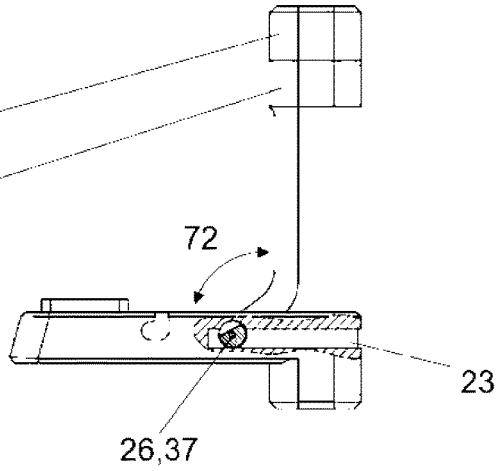

Due to these flattened portions, as can be seen particularly clearly in FIGS. 4A and 4B, the second end section 34 can be pushed into the undercut longitudinal guide 23, but is fixed in its angular position, FIG. 4A. Only when the guide extensions 36 reach the area of the bearing recess 25 during insertion, FIG. 4B, a rotation between the two parts can take place within boundaries. One boundary is practically given with the insertion position shown, since the second end section 34 cannot be rotated clockwise but bears against the bottom of the longitudinal guide. The other boundary is reached when, during a counterclockwise rotation, the end of the end section 34, best visible in FIG. 5B, bears against the bottom of the longitudinal guide. This boundary corresponds to a relative position, in which the two actuating extensions 22, 32 are aligned with one another in the direction normal to the weapon median plane 51. FIGS. 4A and 4B, also clearly show a locking extension 21 of the first actuating element 2, this being the extension which engages in the locking element 61 of the magazine 6 (FIG. 1) and secures the magazine within magazine well 53.

For illustration purposes, the insertion angle 71, which can be slightly smaller than or equal to the opening angle 70, as well as the working angle 72, are also shown. By way of example, the working angle 72 is plotted practically exactly at 90°. The other boundary is thus reached when an end stop is designed such that in the installation position, the working angle 72 lies between 85° and 95°, preferably between 87.5° and 92.5°, and particularly preferably is exactly 90°. The cross-sectional view clearly shows how the guide extensions 36 in the area of the bearing recess 25 are released in their angular position, so that the relative pivoting of the two actuating elements 2, 3 can take place. At the same time, this design ensures that even after a slight pivoting from the position of FIG. 4A, a shifting in the longitudinal guide 23 is no longer possible, and in this respect, the two parts are secured.

Figure 3:
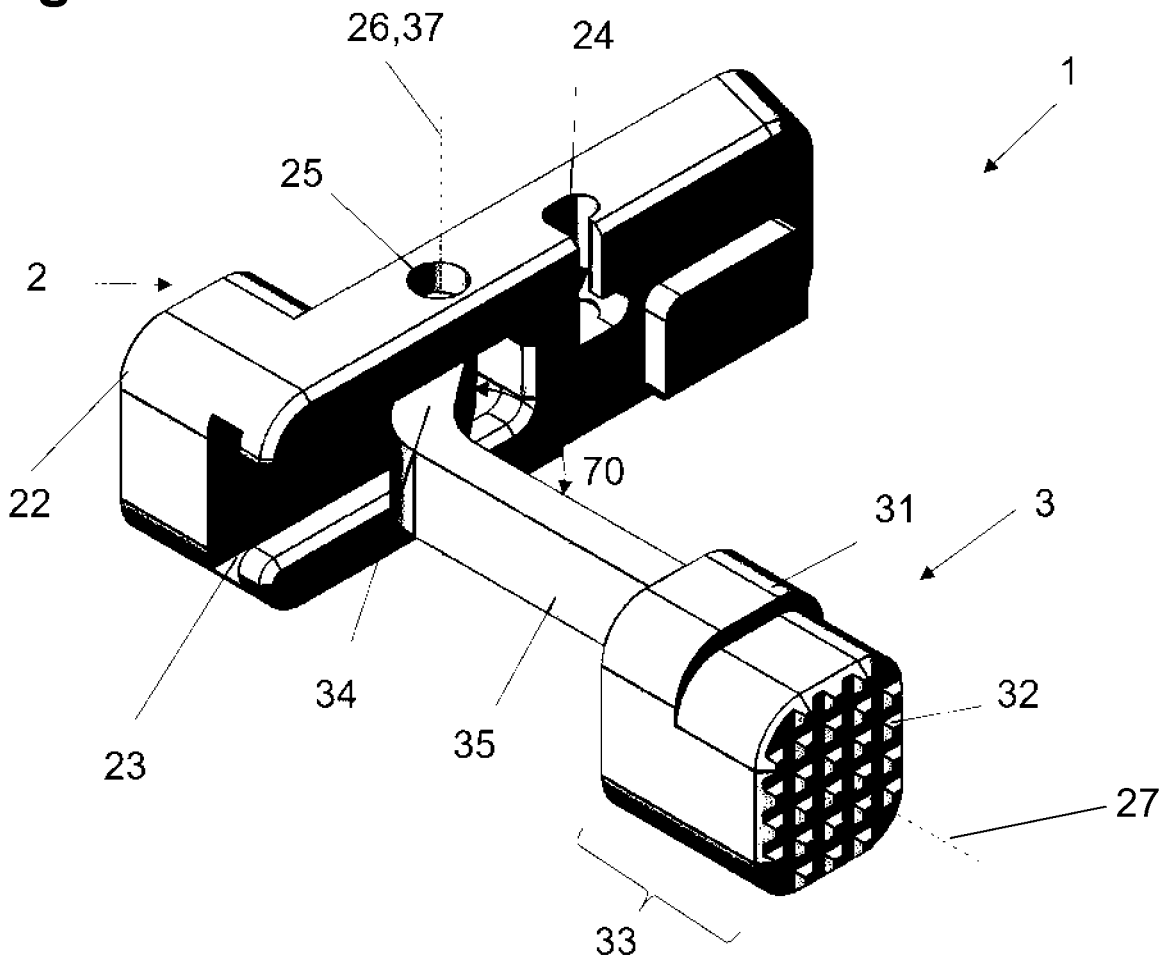
FIG. 3 shows a view similar to that of FIG. 2*a* as shaded depiction, providing a clearer view of the spatial structure.
Figure 5A:
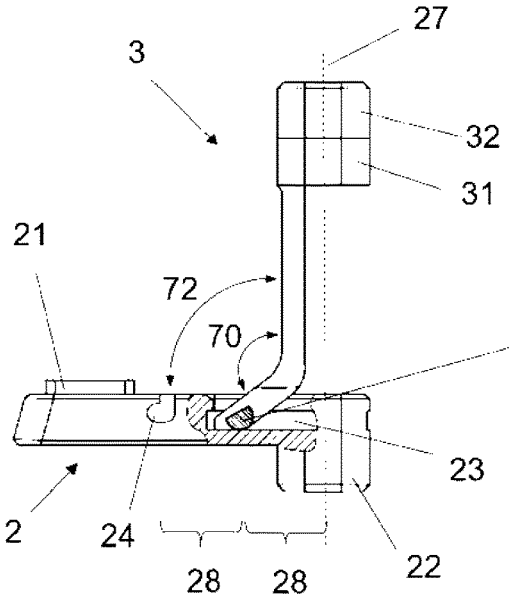
FIG. 5A shows the actuating element of FIG. 4B with additional details.

FIG. 5A shows a view similar to that of FIG. 4B, but with a position of the cross-section in the area beyond the undercut, with the tip of the second end section 34 and its position in the longitudinal guide 23 thus becoming clearly visible. The aligning position of the two actuating extensions 22, 32, is also emphasized by the dotted center line, the actuating axis 27, and two sections are shown which correspond to the lever lengths 28 in case of actuation. For this purpose, it must already be noted that, when pressing on the first, left, actuating extension, approximately in the dotted line, the thickening 31, also called support extension (FIGS. 2 and 3), bears against the weapon housing 5 and prevents any shifting of the second actuating element 3, and so the first actuating element 2 rotates about the thus fixed bearing axis 26=rotational axis 37 against the force of the spring which engages in the spring recess 24, and moves the locking extension 21, as already described, out of the locking element 61. Here, the lever lengths 28 acting in such case are indicated.

Figure 5B:
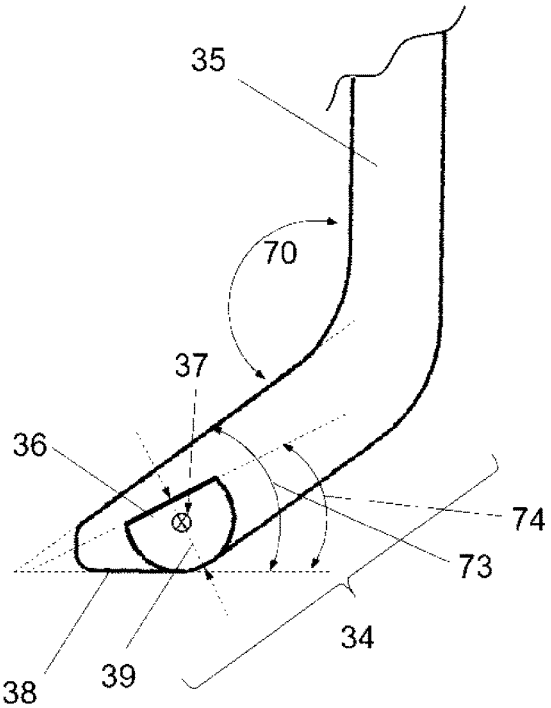
FIG. 5B shows a detail of the actuating element of FIG. 5A on an enlarged scale.

FIG. 5B schematically shows the second end section 34 and enlarged a particular embodiment with its angular relationships. It can be seen that the locking angle 74, formed between the stop 38 and the flattened portion of the guide extension 36, is smaller than the stop angle 73, formed between the stop 38 and the inner surface of the second end section 34. This particular angular relationship allows that the insertion of the second end section 34 in the undercut longitudinal guide 23 is made possible, and that, upon rotation to the working angle 72, a shift protection of the guide extension 36 is formed within the first actuating element 2, as becomes particularly clear from the comparison with FIG. 4A and FIG. 4B. The tip of the end section 34, which forms the stop 38, is also clearly visible. This stop 38 effectively prevents an unwanted "over-rotation" of the second actuating element in the installation position.

Figure 6A:
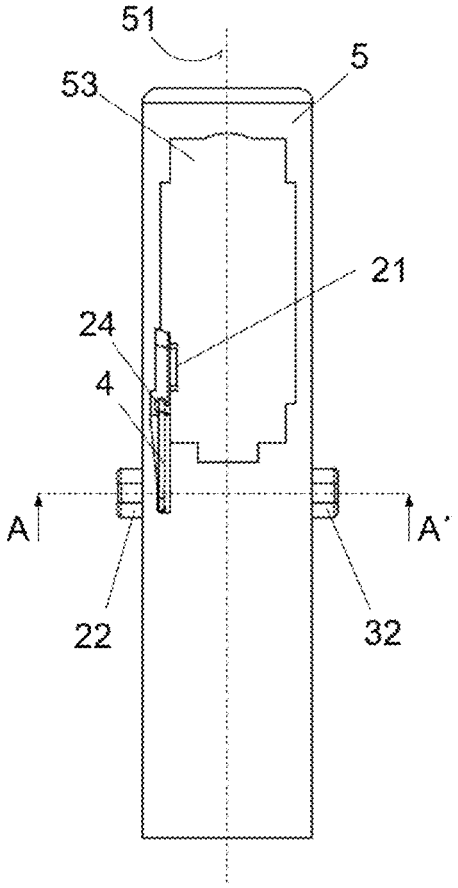
FIGS. 6A and 6B show a top view and a sectional view, respectively, of the installed idle state.
Figure 6B:
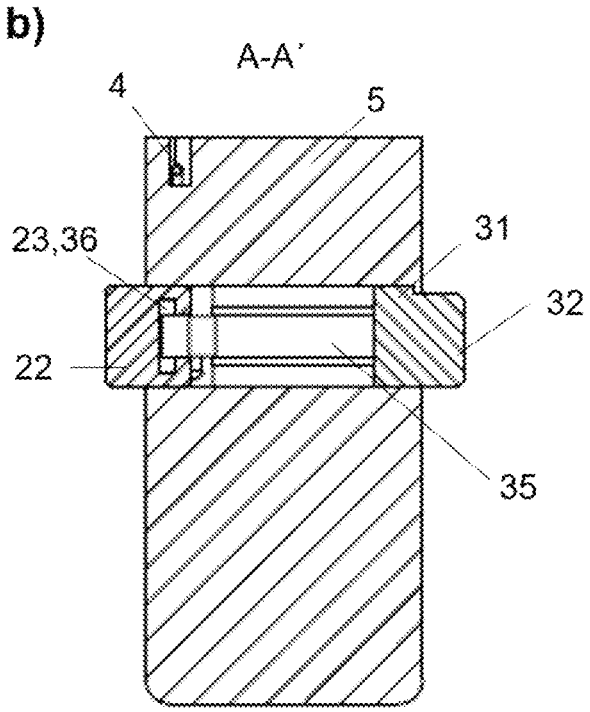

FIGS. 6A and 6B show the situation in the installation state, the installation situation, without the magazine 6 as a top view and/or as a cross-section BB: The actuating extensions 22, 32 protrude over the outer contour of the weapon 5, the locking extension 21 protrudes into the magazine well 53, a spring 4 is inserted in the housing 5 and in the first actuating element 2 and pushes said first actuating element toward the weapon median plane 51. The cross-section of FIG. 6B clearly shows the design and function of the thickening 31 of the second actuating 25 element 3. Under the force of the spring 4, it pushes from the inside against the weapon housing 5 and prevents any further outward movement of the second actuating element 3.

Figure 7A:
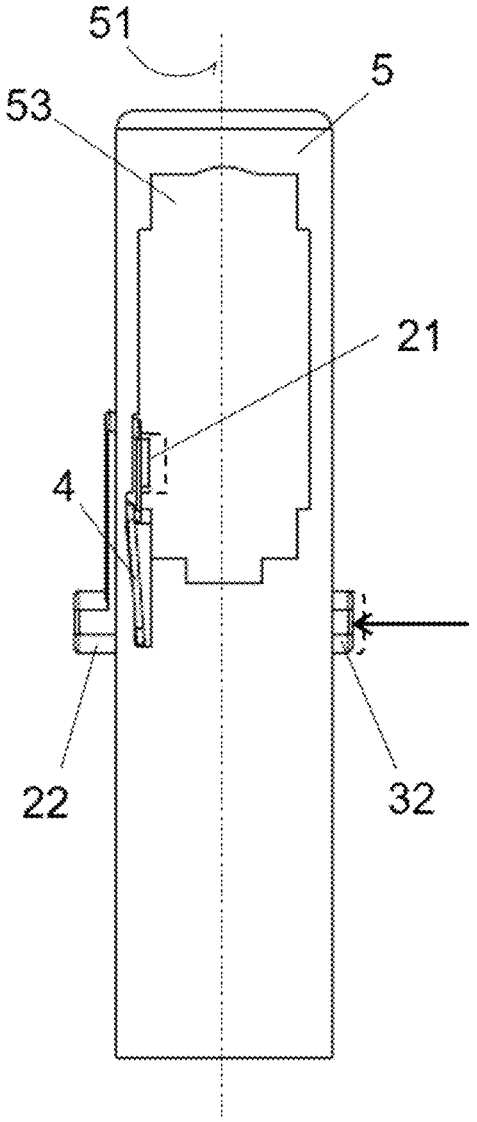
FIGS. 7A and 7B show the drawing of FIG. 6A in the actuation case.
Figure 7B:
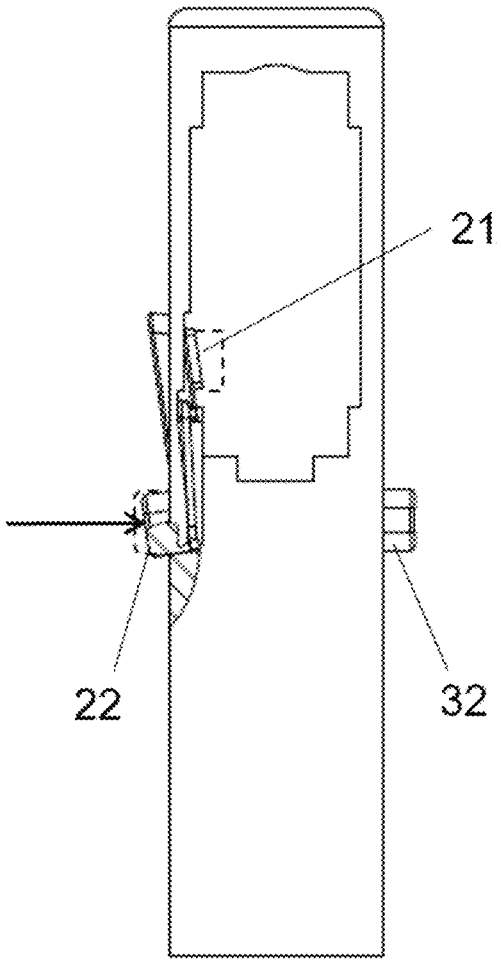

FIGS. 7A and 7B show, in views corresponding to those of FIG. 6A, the actuation of the magazine holder according to the present disclosure: When pressing on the second actuating extension 32 (from the right), FIG. 7A, the two actuating elements 2, 3 are shifted, practically without changing their relative position, against the force of the spring 4, and the locking extension 21 is pushed to the side. Pressing on the first actuating extension 22 (from the left), FIG. 7B, results in the already described rotation of this element against the force of the spring 4 about the rotational axis 37, which also causes the locking extension 21 to be pushed to the side.

In a view transverse from the other side of the weapon than FIG. 1, FIG. 8 shows the situation in the installation state without the magazine: the first actuating element is seated in the holder opening 54 (FIG. 1) and is held in this position by the spring 4. The second actuating element is pushed behind the magazine well 53 approximately normally to the weapon median plane through the weapon housing 5 and protrudes outwardly over its contour. In FIG. 9A, the spring 4 is shown perspectively and, depending on the orientation, it must be regarded to be U-shaped or C-shaped and is inserted with its shorter end section 42 in a recess or groove of the weapon housing 5, and with the other, longer end section 41, which terminates in a securing tip 43, it is inserted in the spring recess 24 of the first actuating element 2. This spring recess 24 is best shown in FIGS. 2, 3, 4A and 4B: It is a blind hole-like groove, which is undercut asymmetrically and in its end area, as can be seen particularly clearly in FIG. 3, it has both a widening of the opening of the groove as well as the undercut, and so the securing tip 43 can be threaded but is then held in place while under the spring effect. This is also clearly shown in FIG. 3.

FIG. 9B shows a variation of the spring; the spring recess 24 would have to be adapted accordingly, which presents no problems.

When compared to known magazine holders, the assembly can now be performed in a simple manner by assembling the first and second actuating element 2, 3 according to the aforementioned steps. The magazine holder 1 is subsequently inserted from the "left" into the weapon housing 5 until the second actuating extension 32 protrudes from the weapon housing on the opposite side. Due to the insertion into the weapon housing 5, an unintentional rotation from the installation position is no longer possible. Finally, the magazine holder 1 is securely fastened against falling out with the spring 4 in the weapon housing 5, and the locking extension 21 is simultaneously pretensioned in the direction of the weapon median plane 51.

Changes, adjustments in given weapons systems, designs, and variations are possible to a great extent.

Thus, it has proven to be advantageous if the guide extension(s) 36 is/are formed such that their height is greater than their radius. In the insertion position, the second end section 34 can in this manner be easily inserted into the longitudinal guide 23 and by rotating within the bearing recess 25, it can be brought into the installation position, in which an accidental disassembly or shifting of the actuating elements toward one another is avoided.

Unlike the drawing, the shape of the spring 4 can be bow-shaped or leaf spring-shaped, wherein a first spring element section engages in the first actuating element and a second spring element section engages in the weapon housing.

In order to allow for a preferably even force for an actuation, i.e., a release movement toward the magazine holder, it can be advantageous that a selected lever length 28 as a distance between the spring recess 25 and bearing axis 26 is essentially equal to the distance between an actuating axis through the center of the first and second actuating extension 2, 3. Analogously, a suitable spring force or spring strength can also be adjusted such that the same objective is achieved. The present instructions allow a person skilled in the art to select the suitable material, its thickness, diameter, etc.

The following numbered paragraphs describe selected additional aspects and features of the firearms of the present disclosure. Each of these paragraphs can be combined with one or more other paragraphs, and/or with disclosure from elsewhere in this application, including materials incorporated by reference, in any suitable manner. Some of the paragraphs below expressly refer to and further limit other paragraphs, providing without limitation examples of some of the suitable combinations.

A1. Firearm having a magazine holder (1) which can be actuated on both sides, comprising: two actuating elements (2, 3) which are movable relative to one another, and a spring (4), wherein the first actuating element (2) has a locking extension (21) protruding in the direction of the weapon median plane (6) for the temporary attachment of a magazine (61) in the firearm, and a first actuating extension (22), wherein the second actuating element (3) has a second actuating extension (32), and the two actuating elements (2, 3) are operatively connected to one another such that the locking extension (21) releases the fastening of the magazine (61) during a release movement onto one of the two actuating elements (2, 3), characterized in that the first actuating element (2) has a longitudinal guide (23) for receiving a second end section (34) of the second actuating element (3) in an insertion position and is rotatably mounted in an installation position about a rotational axis (37) of the second end section (34), wherein the locking extension (21) is pretensioned by means of the spring (4) in the direction of the weapon median plane (6), and the second actuating element (3) is designed to be at least partially received within the first actuating element (2), and in the installation position, it is designed to be essentially opposite of the first actuating element (2) to be supported by the weapon housing (5) in order to effect a release of the magazine (8) by means of the support on the weapon housing (5) when the first actuating element (2) is actuated.

A2. Firearm according to paragraph A1, characterized in that the longitudinal guide (23) has the shape of an undercut groove, into which the second end section (34) of the second actuating element (3), which has at least one, preferably two, aligned guide extensions (36) which are designed as a rotational axis (14) and integrally connected to said second end section, can be inserted.

A3. Firearm according to paragraph A1 or A2, characterized in that the longitudinal guide (23) has a widened bearing recess (25) which, for forming a common pivot point (26, 37) about a bearing axis (26), is designed to have a rotational axis (37) of the at least one guide extension (36) for the first actuating element (2) in the installation state.

A4. Firearm according to one of the paragraphs A1 to A3, characterized in that the first actuating element (2) has a spring recess (24) for receiving a first end section (41) of the spring (4).

A5. Firearm according to one of the previous paragraphs, characterized in that the second actuating element (3) has, in the area of the second actuating extension (32), a support extension (31) which, at least in an area of the circumference, protrudes over the actuating extension (32) and, for supporting the magazine holder (1), is formed on the weapon housing (5).

A6. Firearm according to one of the previous paragraphs, characterized in that the spring (4) has a first end section (41) which is designed to be received in the spring recess (24), and a second end section (42) which is designed to be received in the weapon housing.

A7. Firearm according to one of the previous paragraphs, characterized in that the longitudinal guide (23) is designed to have an at least essentially T-shaped cross-section.

A8. Firearm according to one of the previous paragraphs, characterized in that the at least one guide extension (36) has a circle segment-shaped cross-section surface.

A9. Firearm according to one of the previous paragraphs, characterized in that the second end section (34) has a tip which serves as a stop (38), that the stop (38) delimits a rotation of the actuating elements (2, 3) to one another such that, in the installation position, a working angle (72) between 85° and 95°, preferably between 87.5° and 92.5°, and particularly preferably of exactly 90° is assumed between the main longitudinal axes of the first and second actuating element (2, 3).

A10. Firearm according to one of the paragraphs A8 or A9, characterized in that the at least one guide extension has a height (39) which is greater than its radius.

A11. Firearm according to paragraph A10, characterized in that the height (39) essentially corresponds to a height of the longitudinal guide (23).

A12. Firearm according to one of the previous paragraphs, characterized in that the spring (4) at the first end section (41), which is associated with the weapon housing (5), has a securing extension (43) which protrudes normally to the main longitudinal extension of the first end section (41), and which is designed to be inserted in an undercut or a shape-complementary recess of the spring recess (24).

A13. Firearm according to one of the previous paragraphs, characterized in that the spring (4) is made of a bent wire or spring sheet.

A14. Firearm according to one of the previous paragraphs, characterized in that the second actuating element (3) has a connecting section (35) which, relative to the second end section (34), has an opening angle (70) between 120° and 140°, preferably between 125° and 135°, particularly preferably between 127.5° and 132.5°.

A15. Firearm according to one of the previous paragraphs, characterized in that a lever length (28) as the distance between the spring recess (24) and the bearing axis (26) is essentially equal to the distance between an actuating axis (27) through the center of the first and second actuating extension (22, 32).

In the description and claims, the terms "forward", "rearward", "top", "bottom" and so on are used in the common form and with reference to the object in its normal position of use. This means that, in the case of a weapon, the muzzle of the barrel is "forward", the breech or bolt carrier is moved "rearward" by the explosion gases, etc.

It should be pointed explicitly to the fact that, the use of the terms "left" and "right" in connection with the embodiments of the drawings is purely for easy understanding. It goes without saying that, devices which have a "mirror configuration" in relationship with the weapon median plane are part of the present disclosure as well and are covered by the claims.

It should also be noted that, in the description and claims, indications such as "lower region" of a device or, more generally, an object refer to the lower half and particularly to the lower quarter of the total height. The "lowermost region" refers to the bottom quarter, and particularly to an even smaller portion; and the "center region" refers to the middle third of the total height (width-length). All these indications have their general meaning, applied to the appropriate position of the object viewed (or its specially indicated position).

In the description and claims, "substantially" refers to a deviation of up to 10% of the stated value, if it is physically possible, both downwards and upwards, and otherwise only in the meaningful direction; for degree specifications (angle and temperature), ±10° shall apply.

Unless related to specific examples, all specifications regarding quantities and portions, particularly those for delimiting the disclosed subject matter, are supposed to indicate a ±10% tolerance, for example: 11% means: from 9.9% to 12.1%. For terms such as "a solvent", the word "a" is not to be regarded as a numerical word but as an indefinite article or as a pronoun, unless the context indicates otherwise.

The term "combination" or "combinations" means, unless otherwise stated, all types of combinations, starting from two of the relevant constituents, to a plurality or all of such constituents.

The features and variants specified in the individual embodiments and examples can be freely combined with those of the other examples and embodiments and in particular be used to characterize the invention in the claims without necessarily implying the other details of the respective embodiment or the respective example The following claims particularly point out certain combinations and subcombinations of the disclosed subject matter regarded as novel and nonobvious. Other combinations and subcombinations of features, functions, elements, and/or properties may be claimed in applications claiming priority from this or a related application. Such claims, whether broader, narrower, equal, or different in scope to the original claims, are also regarded as included within the subject matter of the present disclosure.

LISTING OF REFERENCE NUMERALS

| | | | |
|---|---|---|---|
| 1 | Magazine Holder | 4 | Spring Element |
| | | 41 | First spring element section |
| 2 | First Actuating Element (from the "left") | 42 | Second spring element Section |
| 21 | Locking extension | 43 | Securing extension |
| 22 | First actuating extension | | |
| 23 | Longitudinal guide | | |
| 24 | Spring recess | 5 | Weapon (Firearm) Housing |
| 25 | Bearing recess | 51 | Weapon (Firearm) median plane |
| 26 | Bearing axis | 52 | Barrel direction |
| 27 | Actuating axis | 53 | Magazine well |
| 28 | Lever length | 54 | Magazine holder opening |
| 3 | Second Actuating Element (from the "right") | | |
| 31 | Support extension | 6 | Magazine |
| 32 | Second actuating extension | 61 | Locking extension |
| 33 | First end section | 62 | Magazine housing |
| 34 | Second end section | | |
| 35 | Connecting section | 70 | Opening angle |
| 36 | Guide extension(s) | 71 | Insertion angle |
| 37 | Rotational axis | 72 | Working angle |
| 38 | Stop | 73 | Stop angle |
| 39 | Guide extension height | 74 | Locking angle |

What is claimed is:

1. A firearm, comprising:

a firearm housing defining a magazine well; and a magazine holder comprising a first actuating element, a second actuating element, and a spring;

the first actuating element having a first actuating extension at a first end of the first actuating element where the first actuating extension protrudes outward relative to a median plane of the firearm; and a locking extension at a second end of the first actuating element that protrudes inward relative to the firearm median plane; such that the locking extension is configured to engage a recess defined in a housing of a magazine when the magazine is inserted in the magazine well so as to reversibly secure the magazine within the magazine well;

the first actuating element defining a longitudinal guide extending from the first end of the first actuating element, the longitudinal guide having a shape of an undercut groove;

the second actuating element having a second actuating extension at a first end of the second actuating element; and a second end of the second actuating element is configured so that when the second actuating element is disposed in an insertion position the second end of the second actuating element can be slidingly inserted into the longitudinal guide of the first actuating element, wherein the second actuating element is rotatable around a rotational axis at the second end of the second actuating element has at least one aligned guide extension that is integrally connected to the second end of the second actuating element, and the aligned guide extension is designed as a rotational axis such that the second actuating element can be pivoted around the rotational axis from the insertion position to an installation position;

wherein when the second actuating element is in the installation position, the first actuating element and the second actuating element are thus operatively and movably coupled, and the first actuating element is pretensioned by the spring against the firearm housing so as to urge the first actuating element toward the firearm median plane, the first actuating extension and the second actuating extension are therefore symmetrically disposed on the firearm housing with respect to the firearm median plane; and an inward release movement of the first actuating extension will pivot the first actuating element around the rotational axis and thereby disengage the locking extension from the recess in the magazine housing; and an inward release movement of the second actuating extension will translate the first actuating element away from the firearm median plane and thereby disengage the locking extension from the recess in the magazine housing;

such that an inward urging of either the first or second actuating extension releases the magazine reversibly secured within the magazine well.

2. The firearm according to claim 1, characterized in that the at least one guide extension has a height that is greater than its radius.

3. The firearm according to claim 1, characterized in that the at least one guide extension has a height that essentially corresponds to a height of the longitudinal guide.

4. The firearm according to claim 1, wherein the second end of the second actuating element has two aligned guide extensions.

5. The firearm according to claim 1, wherein the at least one guide extension has a circle segment-shaped cross-section surface.

6. The firearm according to claim 1, wherein the longitudinal guide of the first actuating element has a widened bearing recess configured so that when the second actuating element is in the installation position the widened bearing recess forms a common pivot point for the first actuating element and the second actuating element.

7. The firearm according to claim 1, wherein the first actuating element defines a spring recess configured to receive a first end section of the spring.

8. The firearm according to claim 1, wherein the second actuating element further includes a support extension in an area of the second actuating extension, wherein the support extension protrudes circumferentially over the second actuating extension, and is configured to bear against an interior of the magazine well formed in the firearm housing when the first actuating extension is urged inwardly.

9. The firearm according to claim 1, wherein the spring has a first end section that is configured to be received in a spring recess defined by the first actuating element, and a second end that is configured to be received in the firearm housing.

10. The firearm according to claim 9, wherein the first end section of the spring has a securing extension that protrudes normally from a main longitudinal extension of the first end section, and wherein the securing extension is designed to be inserted in an undercut or a shape-complementary recess of the spring recess.

11. The firearm according to claim 1, wherein the longitudinal guide has a substantially T-shaped cross-section.

12. The firearm according to claim 1, wherein the second end of the second actuating element has a tip that serves as a stop that delimits a rotation of the first and second actuating elements relative to one another, such that in the installation position a working angle of between 85° and 95° is assumed between a first main longitudinal axis of the first actuating element and a second main longitudinal axis of the second actuating element.

13. The firearm according to claim 1, wherein the second end of the second actuating element has a tip that serves as a stop that delimits a rotation of the first and second actuating elements relative to one another, such that in the installation position a working angle of 90° is assumed between a first main longitudinal axis of the first actuating element and a second main longitudinal axis of the second actuating element.

14. The firearm according to claim 1, wherein the spring is made of a bent wire or spring sheet.

15. The firearm according to claim 1, wherein the second actuating element includes a connecting section that, relative to the second end of the second actuating element, has an opening angle between 120° and 140°.

16. The firearm according to claim 1, wherein the second actuating element includes a connecting section that, relative to the second end of the second actuating element, has an opening angle between 125° and 135°.

17. The firearm according to claim 1, wherein the second actuating element includes a connecting section that, relative to the second end of the second actuating element, has an opening angle between 127.5° and 132.5°.

18. The firearm according to claim 1, wherein an actuating axis defined by a center of the first actuating extension on the first actuating element and a center of the second actuating extension on the second actuating element extends substantially normal to the firearm median plane, and a lever length corresponding to a distance between the spring recess and a bearing axis is substantially equal to a distance between the actuating axis and the bearing axis.

* * * * *